United States Patent [19]

Fabo et al.

[11] Patent Number: 4,787,543

[45] Date of Patent: Nov. 29, 1988

[54] DISPENSER WITH CUTTING DEVICE

[75] Inventors: Tomas Fabo, Mölnlycke; Rolf Abrahamsson, Mölndal, both of Sweden

[73] Assignee: Molnlycke AB, Goteborg, Sweden

[21] Appl. No.: 53,830

[22] PCT Filed: Sep. 24, 1986

[86] PCT No.: PCT/SE86/00427

§ 371 Date: May 18, 1987

§ 102(e) Date: May 18, 1987

[87] PCT Pub. No.: WO87/02020

PCT Pub. Date: Apr. 9, 1987

[30] Foreign Application Priority Data

Oct. 3, 1985 [SE] Sweden ..... 8504585

[51] Int. Cl.[4] ..... B65D 85/671

[52] U.S. Cl. ..... 225/19; 225/43; 225/52; 225/90

[58] Field of Search ..... 225/19, 20, 43, 51, 225/52, 73, 74, 88–90

[56] References Cited

U.S. PATENT DOCUMENTS

| | | | |
|---|---|---|---|
| 2,708,510 | 5/1955 | Klause . | |
| 2,889,975 | 6/1959 | Hanlon | 225/19 |
| 2,921,493 | 1/1960 | Emmert . | |
| 2,936,936 | 5/1960 | Sano . | |
| 3,190,520 | 6/1965 | Wyant . | |
| 3,843,034 | 10/1974 | Lewandowsky . | |
| 4,196,647 | 4/1980 | Fish . | |

FOREIGN PATENT DOCUMENTS

| | | | |
|---|---|---|---|
| 159978 | 11/1974 | Australia | 225/43 |
| 2755921 | 6/1979 | Fed. Rep. of Germany . | |
| 154629 | 11/1986 | Norway . | |
| 423527 | 5/1982 | Sweden . | |
| 1270052 | 4/1972 | United Kingdom . | |

*Primary Examiner*—Frank T. Yost

*Attorney, Agent, or Firm*—Young & Thompson

[57] ABSTRACT

A disposable dispenser for tough, hardly tearable, unadhesive, weblike rolled-up material. Primarily distinguishing for a dispenser implemented in accordance with the invention is that it includes a roll holder (1) and a part (2) movably connected thereto, the part (b 2) having a knife or the like (3) and a knife guard (4) situated outside the knife, the guard limiting a dispensing gap for the web material situated between the guard and the knife, the movable part being movable between an end position in which withdrawal of the web material (5) over a guiding edge (8) on the roll holder and through the dispensing gap is permitted, and a cutting-off end position in which the web material is cuttable after folding around the knife, the guide having a guide surface (10) extending at least from a position directly opposite the knife and a distance from the roll holder, said surface forming an acute angle to the knife, whereby a piece of web with a length corresponding to the distance between the guiding edge and the knife in its cutting-off end position is led out by the guide surface through the dispensing gap on the return of the movable part form the cutting end position to the withdrawal end position, so that a gripping flap (7) is provided such as to be accessible for a subsequent withdrawal of the web material inside the dispenser.

5 Claims, 3 Drawing Sheets

DISPENSER WITH CUTTING DEVICE

Figure 1:
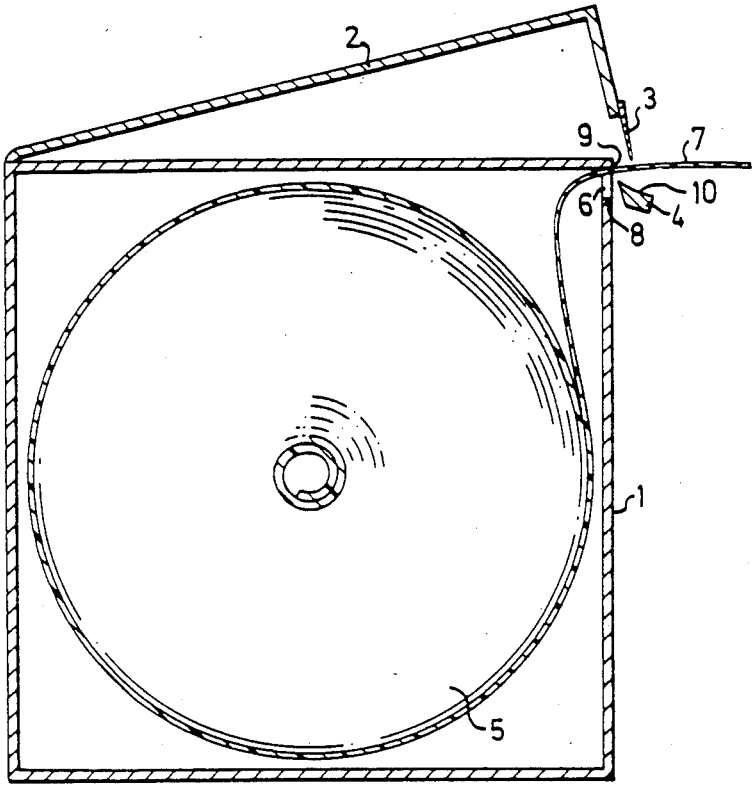
Figure 2A:
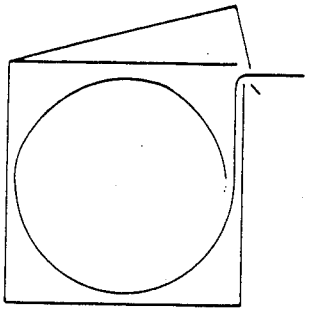
Figure 2B:
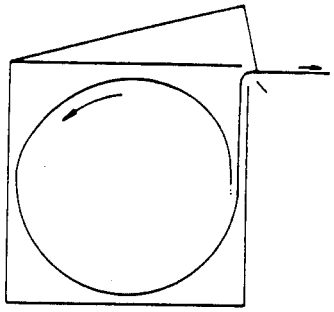
Figure 2C:
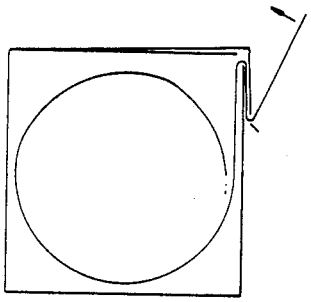
Figure 2D:
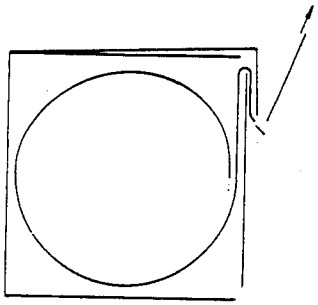
Figure 2E:
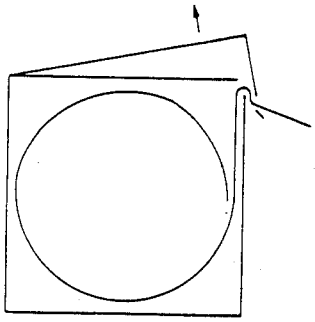

The present invention relates to a dispenser for tough, hardly tearable, unadhesive, weblike rolled-up material.

For a long time there have been on the market several types of such material, which are sold together with disposable dispensers provided with cutting or tearing means. Examples of such are ordinary adhesive tape rolls, plastic film for use in households, drying paper with holders etc. Tearing or cutting-off usually takes place against a serrated edge made from plastics, carton or metal. This edge may not be so sharp that there is the risk of injury due to cuts or tears when pulling-out and tearing-off the rolled-up material.

For certain kinds of tough and hardly tearable materials, e.g. such having a component of textile, non-woven or tough and thick polymer film, a serrated edge of the known kinds is not sufficiently sharp. These materials therefore require the availability of scissors or a sharp knife for the removal of a piece of material.

It has therefore been a desire for a long time to provide a simple dispenser, which functions satisfactorily for tough, hardly tearable, unadhesive, weblike rolled-up materials, e.g. such as those being used for dressing purposes in medical care. Rolls of dressing material have namely been delivered so far in cardboard cartons, which function both as packing and dispenser.

The demands which must be met for such a dispenser to function satisfactorily correspond in general to the ones made on a simple dispenser for an ordinary adhesive tape roll. In the first place, it must be possible to be able to withdraw the rolled-up material from the dispenser with a simple hand movement and without any preparatory operations. It should not be necessary to change the grip of one hand on the dispenser and the other hand on the material web during withdrawal and tearing-off the material web. In the second place there must be no risk of injury due to cuts and tears against the sharp tear-off edge during these operations. Furthermore, tearing-off must be smooth and easy, with a light hand, and transverse the material web.

The situation that strong and tough web material must be folded almost 180° around a knife, even if it is sharp, for comfortable tearing to take place, has so far constituted a considerable problem.

At least certain types of rolled-up material have therefore up to now been cut or clipped with a separate knife or scissors, since the known dispensers have not been able to be provided with a sufficiently sharp knife, due to the risk of cutting injury. This has naturally been a disadvantage, since a separate tool must then always be available, and withdrawing and parting the rolled-up material can not be done in one operation with the same hand movement.

If the serrated edge on known dispensers for tape rolls is replaced with a knife, one does not obtaine a dispenser which functions for the web material in question here, even if the risk of injury on the unprotected knife is overlooked. A further problem with these materials is namely that they often lack adhesive coating, or have such a coating covered by a paper layer treated with a releasing agent.

For self-adhesive rolled-up material, e.g. ordinary adhesive tape, there is obtained a braking action against rolling up again, since the material adheres to the tear-off device as it is torn off. This braking action is not present when the material has no adhesive ability. After the material has been withdrawn and cut off, a flap of it must remain outside the packing so that it can be used as a gripping flap for withdrawing further material.

To avoid cutting injuries, an envisaged dispenser provided with an edge or a knife for tough material must be provided with some type of protection for the sharp edge or knife. Since a non-adhesive material is not braked during tearing-off but is rolled up again instead, it must be inserted between knife and knife guard each time new material is to be withdrawn, which is an undesirable further operation, and would naturally be both time-consuming and irritating in practice.

A similar complication in providing an improved dispenser for strong, tough, rolled-up material is that it must be folded almost 180° around the edge or knife for tearing-off to take place. In dispensers known up to now for rolled-up material, tearing-off takes place when the material is folded about 90° at the tear-off edge.

In the present invention the problems of providing an improved dispenser having a suitable and effective cutting and dispensing device for tough, hardly tearable, unadhesive, weblike rolled-up material have been solved in that the dispenser includes a roll holder and a part movably connected thereto, which has a knife or the like, as well as a knife guard situated outside it, which limits a dispensing gap for the material situated between the guard and the knife, the movable part being movable between an end position in which withdrawal of the material over a guiding edge on the roll holder and through the dispensing gap is permitted, and a cutting-off end position in which the material is cuttable after folding around the knife, the knife guard also having a guide surface extending at least from a position directly opposite the knife and a distance towards the roll holder, this guiding surface forming an acute angle to the knife, whereby a web of material with a length corresponding to the distance between the guiding edge and the knife in its cutting-off end position is led out by the guide surface through the dispensing gap on the return of the movable part from the cutting end position to the withdrawal end position so that a gripping flap is provided such as to be accessible for a subsequent withdrawal of the web material inside the dispenser.

In such a dispenser implemented in accordance with the invention, the movable part may either be displaceable or pivotable in relation to the roll holder. In addition, the movable part of the dispenser may be spring-biased and adapted to have its rest position in the withdrawal end position.

Figure 3:
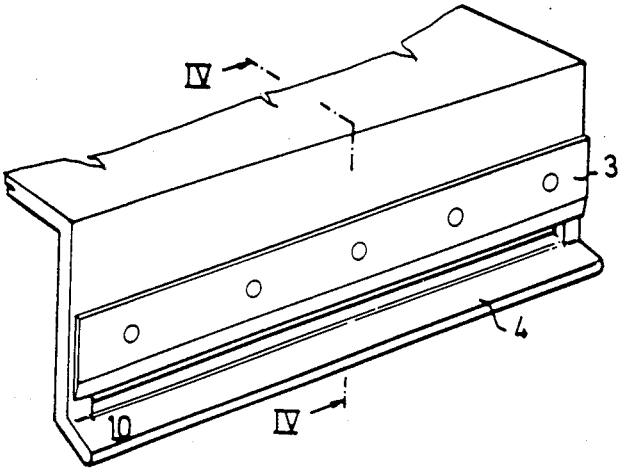
Figure 4:
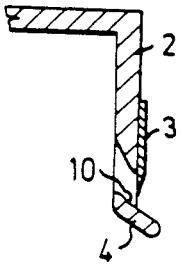

The invention will now be described in detail with reference to an embodiment illustrated on the accompanying drawing, where FIG. 1 is a schematically depicted cross section through a dispenser implemented in accordance with the invention, FIGS. 2*a–e* comprise a pictorial sequence showing withdrawal and cutting-off weblike rolled-up material in this dispenser, FIG. 3 is a perspective view to a larger scale of the cutting device of the dispenser illustrated in FIGS. 1 and 2, and FIG. 4 is a section along the line IV—IV in FIG. 3 through the cutting device.

The dispenser illustrated in FIG. 1 includes a casing 1 and a cutting device 2, which is movable in relation thereto. The device is provided with a knife 3, which is connected to an inclined knife guard 4. Weblike rolled-up material 5 stored in the casing or holder 1 is taken up through a withdrawal opening 6 in the casing or holder and further out between the knife 3 and knife guard 4.

Withdrawal and cutting-off of web material takes place as illustrated in FIGS. *2a–e*. The operator grips the material end 7 projecting out between the knife and knife guard with one hand and holds the casing with the other. The desired length is withdrawn from the casing (FIG. *2b*), the cutting device then being pressed down and the material folded both about a guiding edge 8 in the withdrawal opening 6 of the casing or holder and also about the knife 3 in a manner illustrated in FIG. *2c*. By the folding of material about the guiding edge, the folding angle about the knife will be close to 180°, which considerably facilitates the subsequent cutting-off of the piece of material withdrawn. This material is braked against further withdrawal by the depression of the cutting device and can now, as will be seen from FIG. *2d*, be smoothly cut off transverse the material web by a light pull obliquely upwards. The entire dispensing and cutting procedure can be carried out in one operation without changing hands.

In connection with the depression of the cutting device, a new gripping end 7 of the material is defined between the knife 3 and the guiding edge 8 in the withdrawal opening 6 of the casing or holder 1. When the cutting device returns to the initial position, *2e*, the gripping end 7 is led out by a somewhat inclined surface 10 on the knife guard 4 situated between the knife 3 and the guard 4 and will thereby be accessible for a new withdrawal of material. The edge 9 of the casing or holder withdrawal opening 6 opposite the guiding edge 8 brakes the gripping end 7 of the material during the return of the cutting device 2, so that the gripping end does not roll back into the casing or holder 1.

The cutting device 2, constituting a part pivotably connected to the casing or roll holder 1 is spring biased connected to the casing or holder 1 at a joint and has its rest position in the withdrawal position.

The cutting device 2 illustrated in FIGS. 3 and 4 is provided with a knife 3 and a knife guard 4 mounted outside the knife.

In order to enable its cutting of tough and hardly tearable material, e.g. such with a textile component, the knife 3 must be razor-sharp, and from the safety aspect it is therefore necessary to provide it with the guard 4. The surface 10 on the guard 4 facing towards the knife 3, this surface being at an angle in relation to the knife, serves to lead out the gripping end of the web between the knife and the guard after cutting the material web, as shown in FIG. *2d*, so that the gripping end will be accessible after the return of the cutting device to the material withdrawal position.

The dispenser illustrated here also functions as a pack for the rolled-up material, which further simplifies handling of the material.

The invention is not restricted to the embodiment described here of a dispenser implemented in accordance with it, since a plurality of modifications are possible within the scope of the claims.

For example, the knife guard may be formed by a transverse slot being made through the pivotable part, and the knife mounted so that its edge extends a distance into the slot. In such an embodiment, an inclined guide surface for the web material may comprise a flap left over in making the slot.

The cutting device 2 does not need to be springbiased connected to the casing or holder 1, since return of the cutting device from the cutting position in FIG. *2d* to the withdrawal position in FIG. *2e* can very well be performed manually.

We claim:

1. A dispenser for tough, hardly tearable, weblike rolled-up material, comprising a roll holder (1) and a part (2) movably connected thereto, which has a knife (3) and a knife guard (4) situated outside the knife, the guard limiting a dispensing gap for the web material situated between the guard and the knife, the movable part being movable between an end position in which withdrawal of the web material (5) over a guiding edge (8) on the roll holder (1) and through the dispensing gap is permitted, and a cutting-off end position in which the web material is cuttable after folding around the knife (3), the guard (4) having a guide surface (10) extending at least from a position directly opposite the knife and a distance from the roll holder (1), this surface forming an acute angle to the knife (3), whereby a piece of web with a length corresponding to the distance between the guiding edge (8) and the knife (3) in its cutting end position is led out by the guiding surface through the dispensing gap on the return of the movable part from the cutting end position to the withdrawal end position so that a gripping flap (7) is provided such as to be accessible for a subsequent withdrawal of the web material inside the dispenser.

2. Dispenser as claimed in claim 1, in which the movable part (2) is pivotable in relation to the roll holder (1).

3. Dispenser as claimed in claim 1, in which the movable part (2) is resiliently biased, with its rest position in the withdrawal end position.

4. Dispenser as claimed in claim 1, in which the roll holder (1) comprises a casing with an opening (6) intended for dispensing the web material, an edge (9) of the opening (6) nearest the movable part (2) constituting a brake for the web material when the movable part returns to the withdrawal end position.

5. Dispenser as claimed in claim 4, in which the casing opening (6) is situated directly opposite the dispensing gap in the movable part (2) when the latter is in the withdrawal end position.

* * * * *